US012232684B2

(12) United States Patent
Ren et al.

(10) Patent No.: US 12,232,684 B2
(45) Date of Patent: Feb. 25, 2025

(54) FILTER CLEANING APPARATUS AND FILTER CLEANING SYSTEM

(71) Applicant: TINECO INTELLIGENT TECHNOLOGY CO., LTD., Suzhou (CN)

(72) Inventors: Huaiqiang Ren, Suzhou (CN); Kai Liu, Suzhou (CN); He Xu, Suzhou (CN); Mingyang Ding, Suzhou (CN)

(73) Assignee: TINECO INTELLIGENT TECHNOLOGY CO., LTD., Suzhou (CN)

( * ) Notice: Subject to any disclaimer, the term of this patent is extended or adjusted under 35 U.S.C. 154(b) by 349 days.

(21) Appl. No.: 16/955,629

(22) PCT Filed: Apr. 30, 2019

(86) PCT No.: PCT/CN2019/085218
§ 371 (c)(1),
(2) Date: Jun. 18, 2020

(87) PCT Pub. No.: WO2019/210853
PCT Pub. Date: Nov. 7, 2019

(65) Prior Publication Data

US 2021/0038037 A1 Feb. 11, 2021

(30) Foreign Application Priority Data

May 4, 2018 (CN) ..... 201810419247.5
May 4, 2018 (CN) ..... 201810420074.9

(51) Int. Cl.
*A47L 9/16* (2006.01)
*A47L 9/20* (2006.01)

(52) U.S. Cl.
CPC ..... *A47L 9/20* (2013.01); *A47L 9/165* (2013.01); *A47L 9/1675* (2013.01)

(58) Field of Classification Search
CPC ..... A47L 9/20; A47L 9/165; A47L 9/1675; A47L 9/0693; A47L 9/1666; A47L 9/127
See application file for complete search history.

(56) References Cited

U.S. PATENT DOCUMENTS 4,007,026 A * 2/1977 Groh ..... A47L 11/4041 15/352
4,222,755 A * 9/1980 Grotto ..... B01D 46/26 55/498

(Continued)

FOREIGN PATENT DOCUMENTS

CN 1954762 A 5/2007
CN 200991203 Y 12/2007

(Continued)

OTHER PUBLICATIONS

CN Office Action in application No. 201810419247.5 dated Mar. 19, 2020.

(Continued)

*Primary Examiner* — Dung H Bui
(74) *Attorney, Agent, or Firm* — Maschoff Brennan

(57) ABSTRACT

Provided are a filter cleaning apparatus and a filter cleaning system. The filter cleaning apparatus includes a shielding body, and at least one cleaning strip is arranged on an inner wall of the shielding body, a dust collection connector is arranged on the shielding body, one end of the dust collection connector is communicated with a dust collection apparatus, and the other end of the dust collection connector is communicated with a cavity in the shielding body. By arranging a dust collection connector on the filter cleaning apparatus, when the filter is cleaned, the dirt may be sucked into the dust collection apparatus in real time by the dust collection connector.

13 Claims, 5 Drawing Sheets

(56) References Cited

U.S. PATENT DOCUMENTS

| | | | | |
|---|---|---|---|---|
| 4,246,011 | A | 1/1981 | Oberdorfer | |
| 5,307,538 | A * | 5/1994 | Rench | A47L 9/0009 15/384 |
| 6,391,073 | B1 | 5/2002 | Kogn | |
| 6,598,263 | B2 | 7/2003 | Boles et al. | |
| 2006/0117519 | A1* | 6/2006 | Bock | A47L 9/1472 15/327.7 |
| 2007/0084165 | A1* | 4/2007 | Nakai | B01D 45/18 55/429 |
| 2008/0256744 | A1* | 10/2008 | Rowntreer | A47L 5/24 15/349 |
| 2010/0132154 | A1* | 6/2010 | Sutton | A47L 9/00 15/347 |
| 2010/0154367 | A1* | 6/2010 | Luo | A47L 5/362 55/456 |
| 2010/0306955 | A1* | 12/2010 | Menrik | B04C 5/14 15/347 |
| 2011/0225765 | A1* | 9/2011 | Liu | A47L 9/1666 15/347 |
| 2012/0047683 | A1 | 3/2012 | Kim et al. | |
| 2014/0215752 | A1 | 8/2014 | Loveless et al. | |
| 2016/0174794 | A1* | 6/2016 | Conrad | A47L 5/30 15/347 |
| 2016/0183750 | A1* | 6/2016 | Fan | A47L 13/225 15/347 |
| 2017/0196429 | A1* | 7/2017 | Brown | A47L 11/4075 |
| 2018/0055317 | A1* | 3/2018 | Hyun | B04C 9/00 |
| 2018/0228329 | A1* | 8/2018 | Kim | A47L 9/16 |
| 2018/0345199 | A1* | 12/2018 | Cheng | B01D 50/20 |

FOREIGN PATENT DOCUMENTS

| | | | | |
|---|---|---|---|---|
| CN | 201197695 | Y | 2/2009 | |
| CN | 101455925 | A | 6/2009 | |
| CN | 201384461 | Y | 1/2010 | |
| CN | 101637374 | A | 2/2010 | |
| CN | 101732001 | A | 6/2010 | |
| CN | 101889844 | A | 11/2010 | |
| CN | 201840420 | U | 5/2011 | |
| CN | 102125407 | A | 7/2011 | |
| CN | 102247109 | A | 11/2011 | |
| CN | 102438497 | A | 5/2012 | |
| CN | 203694812 | U | 7/2014 | |
| CN | 105311890 | A | 2/2016 | |
| CN | 105498395 | A | 4/2016 | |
| CN | 105979841 | A * | 9/2016 | A47L 5/24 |
| CN | 208957985 | U | 6/2019 | |
| DE | 27 49 480 | A1 | 5/1979 | |
| DE | 10222656 | A1 * | 6/2003 | A47L 9/165 |
| DE | 10 2013 108 565 | A1 | 2/2015 | |
| EP | 0 169 330 | A2 | 1/1986 | |
| JP | 2007-330457 | A | 12/2007 | |
| JP | 2009-095734 | A | 5/2009 | |
| KR | 20030092883 | A * | 12/2003 | A47L 9/1666 |
| KR | 20040076698 | A * | 9/2004 | A47L 9/1666 |
| SG | 185349 | A1 | 12/2012 | |
| WO | 97/41945 | A1 | 11/1997 | |
| WO | 2012/129774 | A1 | 10/2012 | |
| WO | 2016/000558 | A1 | 1/2016 | |

OTHER PUBLICATIONS

CN Office Action in Application No. 201810419247.5 dated Jun. 12, 2020.

CN Office Action in Application No. 201810419247.5 dated Sep. 30, 2020.

EP Search Report in Application No. 19795822.6 dated Sep. 14, 2021.

CN Office Action dated Jan. 19, 2024 as received in Application No. 201810420074.9.

CN Office Action dated Mar. 12, 2024 as received in Application No. 201810420074.9.

CN Office Action dated Jul. 10, 2024 in application No. 2018104200749.

CN Notice of Rejection dated Oct. 30, 2024 in application 201810420074.9.

* cited by examiner

FILTER CLEANING APPARATUS AND FILTER CLEANING SYSTEM

TECHNICAL FIELD

The present disclosure relates to a filter cleaning apparatus and a filter cleaning system, belonging to the technical field of small household appliance manufacture.

BACKGROUND

Dust collector has become one of daily cleaning tools for a family, and the filter in the dust collector plays the role of dust filtering. During the use, more and more dust is accumulated on the filter, which may influence the use effect. Therefore, the filter needs to be cleaned regularly. At present, the most common cleaning mode of the filter is water washing, after washed by water, and the filter must be dried by air before mounted in the dust collector. Such kind of cleaning mode is complex in process, takes more time and is inconvenient to a user.

SUMMARY

Specific to the disadvantages of the prior art, the technical problem to be solved by the present disclosure is to provide a filter cleaning apparatus and a filter cleaning system thereof. By arranging a dust collection connector on the filter cleaning apparatus, when the filter is cleaned, the dirt may be sucked into the dust collection apparatus in real time by the dust collection connector. Therefore, the filter may be cleaned without water washing and air drying. Moreover, the filter cleaning apparatus does not need to be cleaned regularly, and it is easy to operate, thus optimizing user experience.

The technical problem to be solved by the present disclosure is achieved by the following technical solution:

the present disclosure provides a cleaning apparatus and a filter cleaning system; by arranging a dust collection connector on the filter cleaning apparatus, when the filter is cleaned, the dirt may be sucked into the dust collection apparatus in real time by the dust collection connector. Therefore, the filter may be cleaned without water washing and air drying. Moreover, the filter cleaning apparatus does not need to be cleaned regularly, and it is easy to operate, thus optimizing user experience.

The technical problem to be solved by the present disclosure is achieved by the following technical solution:

the present disclosure provides a filter cleaning apparatus, including a shielding body, where at least one cleaning strip is arranged on an inner wall of the shielding body, and a dust collection connector is arranged on the shielding body; one end of the dust collection connector is communicated with a dust collection apparatus, and the other end of the dust collection connector is communicated with a cavity in the shielding body.

In order to facilitate assembly of the filter, the shielding body includes a front shielding and a rear shielding which are buckled with each other, and the front shielding and the rear shielding are hinged together on one end, and the other end thereof is provided with a positioning portion for buckling.

In order to fix the front shielding and the rear shielding, the positioning portion is a lug boss and an opening hole arranged correspondingly.

Preferably, the shielding body is formed integrally.

In order to fix the cleaning strip, the inner wall of the shielding body is provided with a clamping groove for fixing the cleaning strip, and the clamping groove is correspondingly arranged with a tail end of the cleaning strip.

In order to enhance suction force, a blocking portion is arranged on a side end of the shielding body, and one or more openings are provided in the blocking portion.

Preferably, the cleaning strip is bar-shaped, and the cleaning strip is arranged parallel to a central axis of the shielding body.

Preferably, the cleaning strip is bar-shaped, and the cleaning strip is arranged towards the central axis of the shielding body obliquely.

Preferably, the cleaning strip is arc-shaped, and the cleaning strip is arranged perpendicular to the central axis of the shielding body.

Preferably, the cleaning strip is "V"-shaped.

The present disclosure further provides a filter cleaning system, including a hollow filter and a filter cleaning apparatus, where one end of the filter is provided with an opening, the filter cleaning apparatus includes a shielding body, at least one cleaning strip is arranged on an inner wall of the shielding body, a dust collection connector is arranged on the shielding body, one end of the dust collection connector is communicated with the dust collection apparatus, and the other end of the dust collection connector is communicated with a cavity in the shielding body; a side end of the shielding body is provided with an air inlet, when the filter is assembled in the shielding body, the opening is close to the air inlet, so that at least partial airflow of the air inlet flows through the opening when the filter cleaning system works.

To sum up, in the present disclosure, by arranging a dust collection connector on the filter cleaning apparatus, when the filter is cleaned, the dirt may be sucked into the dust collection apparatus in real time by the dust collection connector. Therefore, the filter may be cleaned without water washing and air drying. Moreover, the filter cleaning apparatus does not need to be cleaned regularly, and it is easy to operate, thus optimizing user experience.

The present disclosure further provides another filter cleaning apparatus, including a shielding body and a covering body, where at least one cleaning strip is arranged on an inner wall of the shielding body; the covering body includes a connecting portion and a fixing portion, and the connecting portion is rotatably sleeved on a side end of the shielding body, and the fixing portion is connected on the shielding body by the connecting portion, and a buckling portion is arranged on a position, towards the shielding body, of the fixing portion.

Preferably, the connecting portion and the fixing portion are formed integrally.

Alternatively, the fixing portion is rotatably connected on the connecting portion by an articulated shaft.

In order to enable the covering body to rotate stably, an annular groove is arranged on the outer wall of a side end of the shielding body, a limiting block is arranged on the connecting portion, and the limiting block is correspondingly arranged to the annular groove.

Preferably, the cleaning strip is bar-shaped, and the cleaning strip is arranged parallel to a central axis of the shielding body.

Preferably, the cleaning strip is bar-shaped, and the cleaning strip is arranged towards the central axis of the shielding body obliquely.

Preferably, the cleaning strip is arc-shaped, and the cleaning strip is arranged perpendicular to the central axis of the shielding body.

Preferably, the cleaning strip is "V"-shaped.

To avoid the accumulation of dirt in the filter cleaning apparatus, the shielding body is provided with a dust collection connector; one end of the dust collection connector is communicated with the dust collection apparatus, and the other end of the dust collection connector is communicated with a cavity in the shielding body.

To enhance the suction force, a blocking portion is arranged on a side end, away from the covering body, of the housing cover, and the blocking portion is provided with one or more openings.

The present disclosure further provides another filter cleaning apparatus, including a shielding body and a covering body, where at least one cleaning strip is arranged on an inner wall of the shielding body, and the covering body is provided with a buckling portion and is capable of being rotatably sleeved on the side end of the shielding body, and the buckling portion of the covering body serves for driving the buckling portion to rotate. To sum up, in the present disclosure, the covering body of the filter cleaning apparatus is rotatably sleeved on the side end of the shielding body, and the filter may be driven by the buckling portion on the covering body to rotate, so that the filter is cleaned by the cleaning strip of the shielding body; the user need not rotate the filter, but rotate the covering body which is easier to hold, thus cleaning the filter, which makes the operation more comfortable and convenient; in addition, the covering body is sleeved on the side end of the shielding body, thus improving the stability of rotation while cleaning the filter, and optimizing the user experience.

Hereinafter, the technical solution of the present disclosure will be described in detail with reference to the accompanying drawings and detailed embodiments.

DETAILED DESCRIPTION OF EXAMPLE EMBODIMENTS

Figure 1:
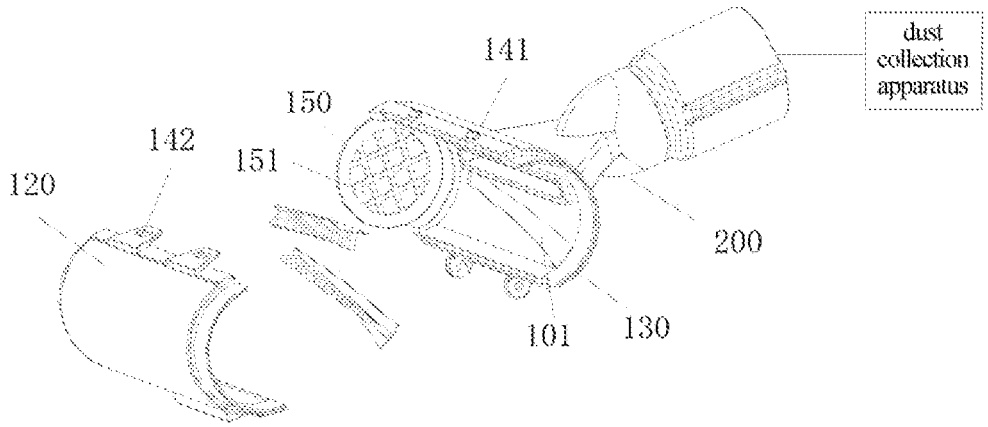
FIG. 1 shows an explosive view of the structure of a filter cleaning apparatus according to the present disclosure.

The technical solutions in the embodiments of the present invention will be clearly and completely described below in combination with the drawings in the embodiments of the present invention. It is apparent that the described embodiments are not all embodiments but part of embodiments of the present invention. All other embodiments obtained by those of ordinary skill in the art on the basis of the embodiments in the present invention without creative work shall fall within the scope of protection of the present disclosure.

"Including" mentioned throughout the description and claims is an inclusive term, therefore, it should be interpreted as "including but not limited to". "Substantially" means that within a range of acceptable errors, those skilled in the art may solve the technical problem and may substantially achieve the technical effect within a certain range of errors.

Furthermore, the term of "connection" includes any direct and indirect means of connection herein. Therefore, if it is described in the article that a first apparatus is connected with a second apparatus, it means that the first apparatus may be directly connected with the second apparatus, or indirectly connected to the second apparatus by other apparatus. The following description is the preferred modes of execution for the present disclosure, and the description still aims at illustrating the general principles of the present disclosure, but it is not intended to limit the scope of the present disclosure. The protection scope of the present disclosure shall be subject to the defined by the appended claims.

It is to be understood that term "and/or" used in the present disclosure is only an association relationship describing associated objects and represents existence of three relationships. For example, A and/or B may represent three conditions, i.e., independent existence of A, coexistence of A and B and independent existence of B. In addition, character "/" in the present disclosure usually represents that previous and next associated objects form an "or" relationship.

In case of no contradiction, those skilled in the art may combine and incorporate the different embodiments or examples and features thereof described in the description.

A filter cleaning apparatus of a dust collector has been disclosed in a Chinese patent (publication No.: CN 201384461Y), which includes a cleaning box capable of containing a filter and a box cover for sealing the opening of the cleaning box, and a brushing is arranged in the cleaning box. When the filter needs to be cleaned, the filter is fixed connection with the box cover, and the box cover is placed at the opening of the cleaning box, then the filter enters into the inside of the cleaning box, afterwards, the box cover is rotated to enable the filter to rotate therewith, and finally, the filter is cleaned up by the brushing in the barrel. Such kind of cleaning mode requires no water washing and air drying, consumes less time and is more convenient; all the dust brushed will be concentrated in the cleaning box, therefore, the cleaning box needs to be cleaned regularly; otherwise the other filter may be polluted by the dirt in the cleaning box when the cleaning box works later on.

Figure 2:
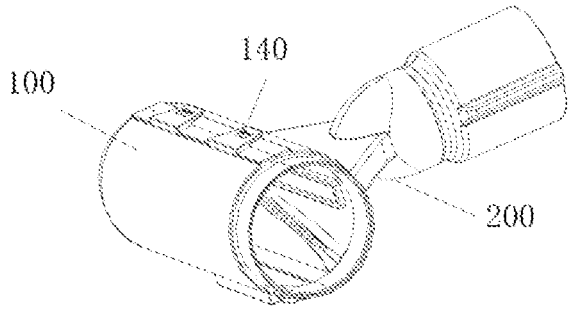
FIG. 2 is a schematic diagram showing the structure of the filter cleaning apparatus according to the present disclosure.

In order to solve the technical problem, the present disclosure provides a filter cleaning apparatus. Specifically, FIG. 1 is an explosive view of the structure of a filter cleaning apparatus according to the present disclosure; and FIG. 2 shows a structure of the filter cleaning apparatus according to the present disclosure. As shown in FIG. 1 and FIG. 2, the filter cleaning apparatus provided by the present disclosure includes a shielding body 100; at least one cleaning strip is arranged on an inner wall of the shielding body 100, and the cleaning strip is used for cleaning the filter, preferably, the cleaning strip is a wool top or rubber strip. A dust suction connector 200 is arranged on the shielding body 100, and one end of the dust suction connector 200 is communicated with the dust collection apparatus, and the other end of the dust suction connector 200 is communicated with a cavity in the shielding body 100; dirt in the shielding body 100 is sucked into the dust connection apparatus by the dust collection connector 200 under the suction force provided by the dust collection apparatus, so that the dust on the filter may be immediately sucked away after scraped by the cleaning strip, thus achieving the cleaning of the shielding body 100 while cleaning the filter.

The present disclosure is not limited to the shape of the shielding body 100 as long as it may be encased into the filter and the cleaning strip. Preferably, for the convenience of accommodation and filter cleaning, the shielding body 100 is a hollow cylinder.

The shielding body 100 may be integrally formed or composed of a plurality of components. To facilitate the assembly and disassembly of the filter, preferably, the shielding body 100 includes a front shielding 120 and a rear shielding 130 which are buckled with other, the cross sections of the front shielding 120 and the rear shielding 130 are both semicircular, the front shielding 120 and the rear shielding 130 are hinged on one end, and the other end thereof is provided with a positioning portion 140 for buckling. The positioning portion 140 includes, but not limited to, a lug boss 141 and an opening hole 142 (as shown in FIG. 1) arranged correspondingly. The dust collection connector 200 is arranged on one side, away from the front shielding 120, of the rear shielding 130; more preferably, the dust collection connector 200 is arranged in the middle of the rear shielding 130.

The filter is mounted from a side end of the shielding body 100 to complete the assembly of the filter and the filter cleaning apparatus when the shielding body 100 is formed integrally. When the shielding body 100 includes the front shielding 120 and the rear shielding 130 hinged together, the positioning portion 140 may be opened so that the front shielding 120 and the rear shielding 130 rotate relatively for separation around the articulated shaft, thus mounting the filter easily, afterwards, the positioning portion 140 is buckled to complete the assembly of the filter and the filter cleaning apparatus.

The cleaning strip may be fixed on the inner wall of the shielding body 100, for example, it may be pasted by adhesive or by directly machined into an integral structure. To facilitate the maintenance and cleaning of the cleaning strip, the cleaning strip is detachably fixed on the inner wall of the shielding body 100. Specifically, a clamping groove 101 is arranged on the inner wall of the shielding body 100, the clamping groove 101 is correspondingly arranged to the tail end of the cleaning strip; the tail end of the cleaning strip is inserted into the clamping groove 101 to achieve the assembly/disassembly thereof.

To improve the airflow velocity of the shielding body 100 and effectively suck out dirt, when the dust collection connector 200 is connected with the dust collection apparatus, a blocking portion 150 is arranged on a side end of the shielding body 100, and the blocking portion 150 is provided with one or more openings; when the dust collection apparatus works, airflow enters from the openings, and flows through the filter assembled in the shielding body 100, then flows out of the dust collection connector 200. The configuration of the blocking portion 150 reduces the inlet air area of the side end of the shielding body 100, which may effectively improve the speed of the inlet air in case of constant power, that is to say, the suction force can be effectively enhanced, thus sucking away the dirt scraped during cleaning process by the dust collection apparatus more efficiently.

The blocking portion 150 may be integrally formed with the shielding body 100, or may be fixed onto the side end of the shielding body 100 after formed separately.

The working process of the filter cleaning apparatus in the present disclosure is as follows:

at the end of cleaning, the filter on the dust collector is disassembled and assembled in the filter cleaning apparatus; specifically, the filter is abutted against the cleaning strip in the assembled state; the dust collection connector 200 is connected with the dust collection apparatus and the dust collection apparatus is turned on; then, the dirt on the filter is brushed by the cleaning strip to achieve the separation from the filter by rotating (taking the central axis of the filter as a rotating shaft) the filter or drawing (making the filter moving along with the central axis of the filter) the filter, so that the dirt is sucked away by the dust collection apparatus after falling into the filter cleaning apparatus.

It should be noted that the rotating or drawing mentioned above may be both achieved by user's manual operation and achieved automatically by setting a corresponding motor.

Figure 7:
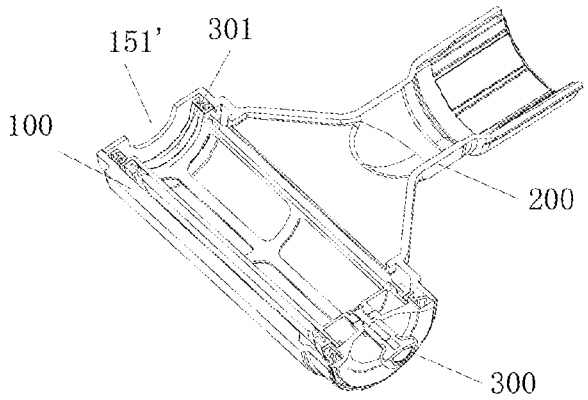
FIG. 7 shows a sectional view of a filter cleaning system according to the present disclosure.
Figure 8:
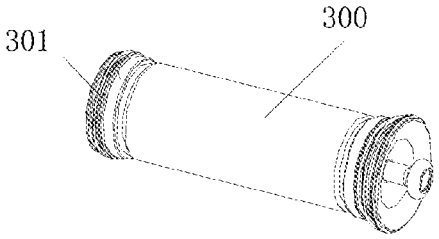
FIG. 8 is a schematic diagram showing the structure of a filter according to the present disclosure.
Figure 9:
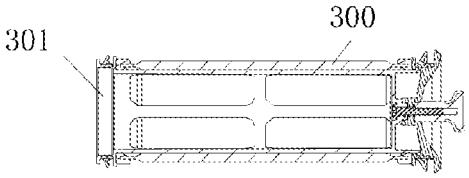
FIG. 9 is a sectional view showing the structure of the filter according to the present disclosure.

FIG. 7 shows a sectional view of a filter cleaning system according to the present disclosure; FIG. 8 is a schematic diagram showing the structure of a filter according to the present disclosure; and FIG. 9 is a sectional view showing the structure of the filter according to the present disclosure. As shown in FIGS. 7-9, the present disclosure also provides a filter cleaning system; the filter cleaning system includes a hollow filter 300 and a filter cleaning apparatus, one end of the filter 300 is provided with an opening 301; the filter cleaning apparatus includes a shielding body 100, and at least one cleaning strip is arranged on the inner wall of the shielding body 100; the shielding body 100 is provided with a dust suction connector 200, one end of the dust suction connector 200 is connected with dust suction apparatus, and the other end of the dust suction connector 200 is in communicated with a cavity in the shielding body 100.

An air inlet 151' is opened on the side end of the shielding body 100, and the filter 300 is assembled in the shielding body 100 in the filter cleaning apparatus when the filter 300 needs to be cleaned. Specifically, one end, having the opening 301, of the filter 300 is positioned at the same side as the side end, having the air inlet 151', of the shielding body 100, i.e., the opening 301 is positioned adjacent to the air inlet 151', so that at least partial airflow enters into the filter cleaning apparatus from the air inlet 151' flows through the opening 301, and then flows into the inside of the filter 300 when the filter cleaning system works. Taking the length direction of the filter 300 as an axial direction, preferably, the axial projection area of the air inlet 151' is located within the axial projection area of the opening 301 after assembly, and the opening 301 is abutted against the air inlet 151' after assembly, so that all of the airflow entering into the filter cleaning apparatus from the air inlet 151' flow through the opening 301, and then flow into the inside of the filter 300 when the filter cleaning system works. Taking the length direction of the filter 300 as an axial direction, preferably, the axial projection area of the air inlet 151' is partially overlapped with the axial projection area of the opening 301 after assembly, and the opening 301 is abutted against or is close to the air inlet 151' after assembly, so that a part of airflow entering into the filter cleaning apparatus from the air inlet 151' flows through the opening 301, and then flows the inside of the filter 300 and the other part of airflow flows through the outside of the filter 300 directly when the filter cleaning system works.

At the end of assembly, the dust collection connector 200 is connected with the dust collection apparatus and the dust collection apparatus is opened, airflow enters into the inside of the filter 300 from the air inlet 151'; due to the fact that the opening 301 is arranged on the same side as the air inlet 151' and is close to the air inlet 151', at least partial airflow may flow through the outside of the opening 301 from the inside of the filter 300, and finally the airflow is discharged from the dust collection connector 200. Therefore, the above configuration enables the dirt inside the filter 300 to be cleaned effectively, which makes up the defect that the dirt outside the filter may be cleaned by the cleaning strip only in the conventional filter cleaning apparatus; namely, the filter cleaning system of the present disclosure can simultaneously clean the dirt inside/outside the filter effectively.

The filter cleaning apparatus of the present disclosure will be described with reference to detailed embodiments hereafter.

Embodiment 1

Figure 3:
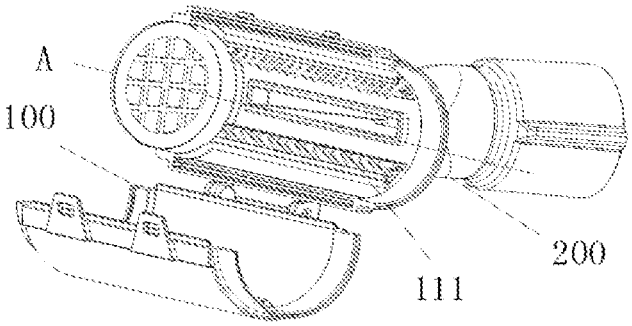
FIG. 3 is a schematic diagram showing the structure of cleaning strips according to Embodiment 1 of the present disclosure.

FIG. 3 is a schematic diagram showing the structure of cleaning strips according to Embodiment 1 of the present disclosure. As shown in FIG. 3, the cleaning strip of the filter cleaning apparatus in the present embodiment is a first cleaning strip 111, and the first cleaning strip 111 is strip-shaped and disposed parallel to the central axis A of the shielding body 100. One or more first cleaning strips 111 may be available, and in the present embodiment, the number of the first cleaning strips 111 may be two.

In the present embodiment, after the filter is loaded into the filter cleaning apparatus, to achieve the separation of the dirt and the filter, preferably, the filter may be cleaned by rotation since the first cleaning strip 111 is parallel to the central axis A of the shielding body 100.

Embodiment 2

Figure 4:
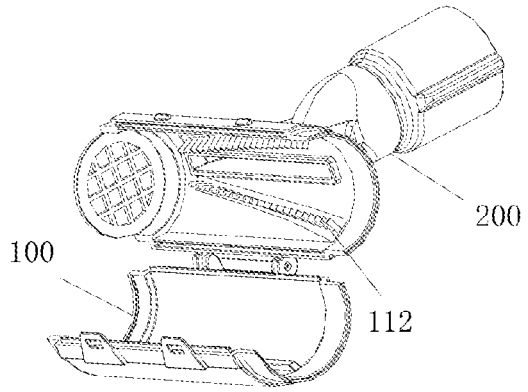
FIG. 4 is a schematic diagram showing the structure of cleaning strips according to Embodiment 2 of the present disclosure.

FIG. 4 is a schematic diagram showing the structure of cleaning strips according to Embodiment 2 of the present disclosure. As shown in FIG. 4, the difference between the present embodiment and Embodiment 1 is that the configuration of the cleaning strip is changed. Specifically, in the present embodiment, the cleaning strip is a second cleaning strip 112, and the second cleaning strip 112 is strip-shaped. Moreover, the second cleaning strip 112 is disposed obliquely to the central axis of the shielding body 100, that is, there is an included angle between the second cleaning strip 112 and the central axis of the shielding body 100; the included angle is an acute angle. One or more second cleaning strips 112 may be available, and in the present embodiment, the number of the second cleaning strips 112 may be two.

In the present embodiment, after the filter is loaded into the filter cleaning apparatus, to achieve the separation of the dirt and the filter, the filter may be cleaned by rotation or drawing since the first cleaning strip 111 is inclined to the central axis of the shielding body 100.

Embodiment 3

Figure 5:
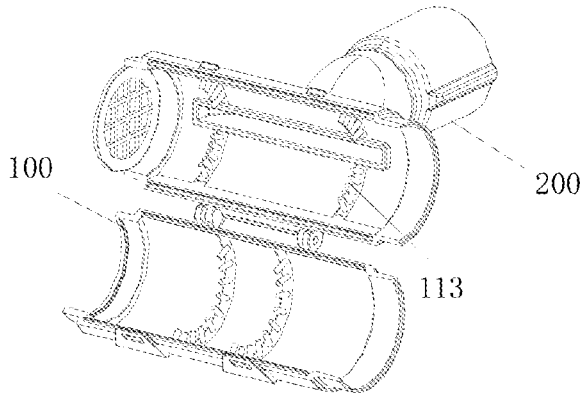
FIG. 5 is a schematic diagram showing the structure of cleaning strips according to Embodiment 3 of the present disclosure.

FIG. 5 is a schematic diagram showing the structure of cleaning strips according to Embodiment 3 of the present disclosure. As shown in FIG. 5, the difference between the present embodiment and Embodiment 1 is that the structure of the cleaning strip is changed. Specifically, in the present embodiment, the cleaning strip is a third cleaning strip 113; the third cleaning strip 113 is arc-shaped and is disposed perpendicular to the central axis of the covering body 100, i.e., the third cleaning strip 113 is annularly distributed on the inner wall of the shielding body 100. One or more third cleaning strips 113 may be available, and in the present embodiment, the number of the second cleaning strips 113 may be four.

In the present embodiment, after the filter is loaded into the filter cleaning apparatus, to achieve the separation of the dirt and the filter, preferably, the filter may be cleaned b drawing since the third cleaning strip 113 is perpendicular to the central axis of the shielding body 100.

Embodiment 4

Figure 6:
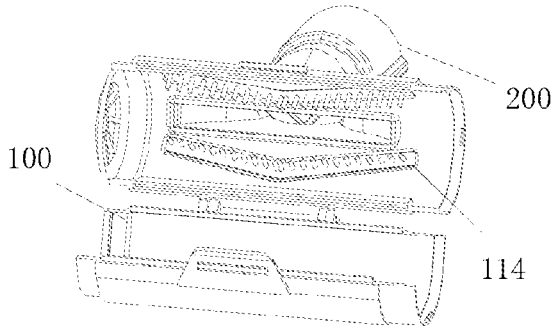
FIG. 6 is a schematic diagram showing the structure of cleaning strips according to Embodiment 4 of the present disclosure.

FIG. 6 is a schematic diagram showing the structure of cleaning strips according to Embodiment 4 of the present disclosure. As shown in FIG. 6, the difference between the present embodiment and Embodiment 1 is that the structure of the cleaning strip is changed. Specifically, in the present embodiment, the cleaning strip is a fourth cleaning strip 114 which is "V"-shaped. One or more fourth cleaning strips 114 may be available, and in the present embodiment, the number of the fourth cleaning strips 114 may be two.

In the present embodiment, after the filter is loaded into the filter cleaning apparatus, to achieve the separation of the dirt and the filter, the filter may be cleaned by rotation or drawing since the first cleaning strip 114 are "V"-shaped.

To sum up, in the present disclosure, by arranging a dust collection connector on the filter cleaning apparatus, when the filter is cleaned, the dirt may be sucked into the dust collection apparatus in real time by the dust collection connector. Therefore, the filter may be cleaned without water washing and air drying. Moreover, the filter cleaning apparatus does not need to be cleaned regularly, and it is easy to operate, thus optimizing user experience.

Figure 10:
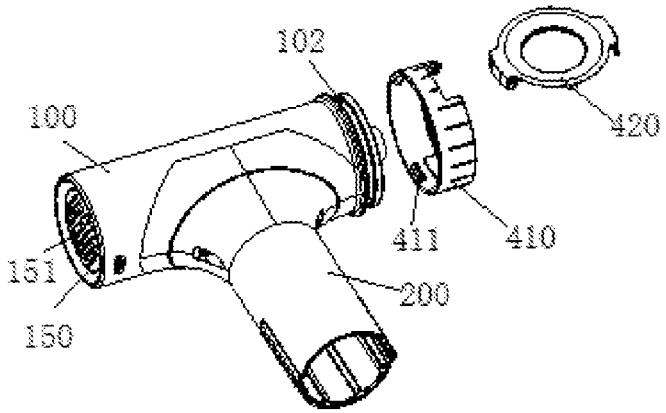
FIG. 10 shows an explosive view of the structure of a filter cleaning apparatus according to the present disclosure.
Figure 11:
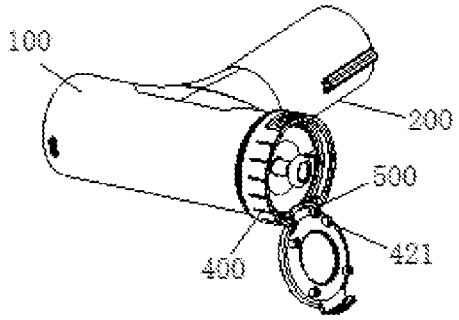
FIG. 11 is a schematic diagram showing the structure of filter cleaning apparatus according to the present disclosure.

FIG. 10 shows an explosive view of the structure of a filter cleaning apparatus according to the present disclosure; and FIG. 11 is a schematic diagram showing the structure of filter cleaning apparatus according to the present disclosure. As shown in FIG. 10 and FIG. 11, the present disclosure also provides another filter cleaning apparatus, including a shielding body 100 and a covering body 400; at least one cleaning strip is arranged on an inner wall of the shielding body 100, and the cleaning strip is used for cleaning the filter, preferably, the cleaning strip is a wool top or rubber strip; the covering body 400 is arranged on a side end of the shielding body 100.

In order to facilitate accommodation and filter cleaning, the shielding body 100 of the present disclosure is a hollow cylinder. The shielding body 100 may be formed by splicing a plurality of components; preferably, the shielding body 100 is formed integrally. At this time, the filter is mounted from a side end of the shielding body 100 to complete the assembly of the filter and the filter cleaning apparatus.

The cleaning strip may be fixed on the inner wall of the shielding body 100, for example, it may be pasted by adhesive or by directly machined into an integral structure. To facilitate the maintenance and cleaning of the cleaning strip, the cleaning strip is detachably fixed on the inner wall of the shielding body 100. Specifically, a clamping groove (not shown in the drawings) is arranged on the inner wall of the shielding body 100, and the clamping groove is correspondingly arranged to the tail end of the cleaning strip; the tail end of the cleaning strip is inserted into the clamping groove to achieve the assembly/disassembly thereof.

The covering body 400 includes a connecting portion 410 and a fixing portion 420, and the connecting portion 410 is rotatably sleeved on a side end of the shielding body 100 and is used for connecting the fixing portion 420 on the shielding body 100; a buckling portion 421 is arranged on a position, towards the shielding body 100, of the fixing portion 420. Specifically, the buckling portion 421 may be a lug boss or a groove, but is not limited thereto as long as its shape can be buckled with the filter accordingly.

Specifically, the connecting portion 410 is ring-shaped correspondingly when the shielding body 100 is hollow cylinder. To restrain the rotation track of the connecting portion 410 on the side end of the shielding body 100, thus making the covering body 400 rotating stably and ensuring its cleaning efficiency thereby, an annular groove 102 is arranged on the outer wall of the side end of the shielding body 100; the connecting portion 410 is provided with a limiting block 411, and the limiting block 411 is correspondingly arranged to the annular groove 102. The limiting block 411 is clamped into the annular groove 102 after the connecting portion 410 is assembled on the side end of the shielding body 100; the limiting block 411 is restrained by the annular groove 102 when a user rotates the connecting portion 410, thus making the connecting portion 410 rotating stably.

In general, for the convenience of assembly, the side end face of the existing filter on the market is non-planar and has a concave-convex structure, e.g., the side end face is provided with a positioning hole or positioning column. As the buckling portion 421 on the fixing portion 420 is arranged towards the inside of the shielding body 100, and when the connecting portion 410 rotates, the buckling portion 421 contacts the corresponding concave-convex structure on the filter during the rotating process, thus driving the filter to rotate; the filter is scraped by the cleaning strip when rotating, and dirt attached on the filter is scraped into the filter cleaning apparatus.

For the convenience of manufacture, the buckling portion 421 may be integrally formed with the fixing portion 420.

In order to accommodate different kinds of filters, the buckling portion 421 may be separately formed and detachably fixed on the fixing portion 420. Specifically, a plurality of fixing grooves (not shown in the drawings) are arranged on a position, towards the inside of the shielding body 100, of the fixing portion 420, and the number and specific position of the fixing grooves on the fixing portion 420 are not limited in the present disclosure. For example, the number of the fixing grooves may be four, and these are annularly distributed on the inner wall of the fixing portion 420. In the present disclosure, the buckling portions 421 may correspond to the fixing grooves one by one, namely, each fixing groove is provided with a buckling portion 421. The number of the buckling portions 421 may be more or less than that of the fixing grooves, for example, the number of the buckling portions 421 is two when there are four fixing grooves and the position of the buckling portions may be chosen by the user according to the structure of the filter freely; additionally, in actual operation, the buckling portions 421 in different height may be replaced according to the buckling conditions between the buckling portion 421 and the filter, so that the fixing portions 420 of the present disclosure can be adapted to more kinds of filters.

In the present embodiment, the number of the buckling portions 421 is four, and these are annularly distributed on the fixing portion 420.

The connecting portion 410 and the fixing portion 420 may be integrally formed or formed by assembly.

When the connection portion 410 and the fixing portion 420 are formed integrally, if the filter is to be cleaned, the covering body 400 needs to be removed from the side end of the shielding body 100, then the filter is mounted, afterwards, the covering body 400 is assembled on the side end of the shielding body 100, so that the limiting block 411 on the connecting portion 410 of the covering body 400 is buckled into the annular groove 102 on the outer wall of the side end of the shielding body 100, and finally the filter is cleaned by rotating the covering body 400.

When the connecting portion 410 and the fixing portion 420 are formed by assembly, as shown in FIG. 11, the connecting portion 410 and the fixing portion 420 may be coupled together by the articulated shaft 500 in a counter-rotating manner, and at this time, the filter can be mounted by opening the fixing portion 420 only without removing the covering body 400. Specifically, the user may open the fixing portion by making the fixing portion 420 rotating with the articulated shaft 500.

In order to avoid the accumulation of dirt in the filter cleaning apparatus, a dust suction connector 200 is arranged on the shielding body 100, one end of the dust suction connector 200 is communicated with the dust collection apparatus, the other end of the dust suction connector 200 is communicated with a cavity in the shielding body 100; and dirt in the shielding body 100 is sucked into the dust connection apparatus by the dust collection connector 200 under the suction force provided by the dust collection apparatus, so that the dust on the filter can be immediately sucked away after scraped by the cleaning strip, thus achieving the cleaning of the shielding body 100 while cleaning the filter.

To improve the airflow velocity of the shielding body 100 and effectively suck out dirt, when the dust collection connector 200 is connected with the dust collection apparatus, a blocking portion 150 is arranged on a side end, away from the covering body 400, of the shielding body 100, and the blocking portion 150 is provided with one or more openings 151; when the dust collection apparatus works, airflow enters from the openings, and flows through the filter assembled in the shielding body 100, then flows out of the dust collection connector 200. The configuration of the blocking portion 150 reduces the inlet air area of the side end of the shielding body 100, which may effectively improve the speed of the inlet air in case of constant power, that is to say, the suction force can be effectively enhanced, thus sucking away the dirt scraped during cleaning process by the dust collection apparatus more efficiently.

The blocking portion 150 may be integrally formed with the shielding body 100, or may be fixed onto the side end of the shielding body 100 after formed separately.

The filter cleaning apparatus of the present disclosure will be described with reference to detailed embodiments hereafter.

Embodiment 5

Figure 12:
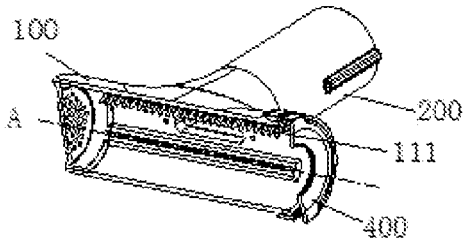
FIG. 12 is a sectional view showing the structure of cleaning strips according to Embodiment 5 of the present disclosure.

FIG. 12 is a sectional view showing the structure of cleaning strips according to Embodiment 5 of the present disclosure. As shown in FIG. 12, the cleaning strip of the filter cleaning apparatus in the present embodiment is a first cleaning strip 111, and the first cleaning strip 111 is strip-shaped and disposed parallel to the central axis A of the shielding body 100. One or more first cleaning strips 111 may be available, and in the present embodiment, the number of the first cleaning strips 111 may be two.

In the present embodiment, after the filter is mounted in the filter cleaning apparatus, the covering body 400 is rotated so that the filter is driven by the buckling portion 421 on the covering body 400 to rotate, thus cleaning the dirt on the filter by the cleaning strips.

Embodiment 6

Figure 13:
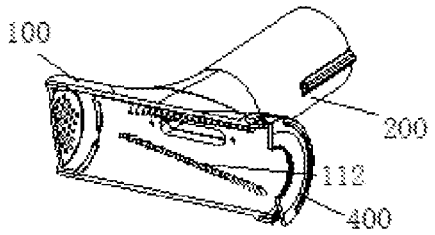
FIG. 13 is a sectional view showing the structure of cleaning strips according to Embodiment 6 of the present disclosure.

FIG. 13 is a sectional view showing the structure of cleaning strips according to Embodiment 6 of the present disclosure. As shown in FIG. 13, the difference between the present embodiment and the Embodiment 5 is that the configuration of the cleaning strip is changed. Specifically, in the present embodiment, the cleaning strip is a second cleaning strip 112; the second cleaning strip 112 is strip-shaped and is disposed obliquely to the central axis of the shielding body 100, that is, there is an included angle between the second cleaning strip 112 and the central axis of the shielding body 100, and the included angle is an acute angle. One or more second cleaning strips 112 may be available, and in the present embodiment, the number of the second cleaning strips 112 may be two.

In the present embodiment, after the filter is mounted in the filter cleaning apparatus, the covering body 400 is rotated so that the filter is driven by the buckling portion 421 on the covering body 400 to rotate, thus cleaning the dirt on the filter by the cleaning strips.

Embodiment 7

Figure 14:
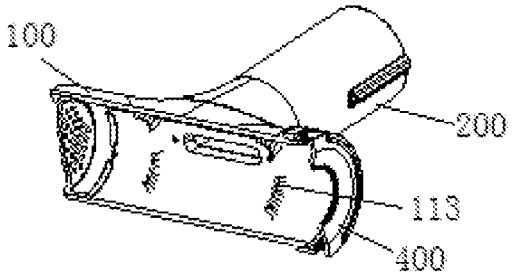
FIG. 14 is a sectional view showing the structure of cleaning strips according to Embodiment 7 of the present disclosure.

FIG. 14 is a sectional view showing the structure of cleaning strips according to Embodiment 7 of the present disclosure. As shown in FIG. 14, the difference between the present embodiment and Embodiment 5 is that the structure of the cleaning strip is changed. Specifically, in the present embodiment, the cleaning strip is a third cleaning strip 113; the third cleaning strip 113 is arc-shaped and is disposed perpendicular to the central axis of the shielding body 100, i.e., the third cleaning strip 113 is distributed annularly on the inner wall of the shielding body 100. One or more third cleaning strips 113 may be available, and in the present embodiment, the number of the second cleaning strips 113 may be four.

In the present embodiment, after the filter is mounted in the filter cleaning apparatus, the covering body 400 is rotated so that the filter is driven by the buckling portion 421 on the covering body 400 to rotate, thus cleaning the dirt on the filter by the cleaning strips.

Embodiment 8

Figure 15:
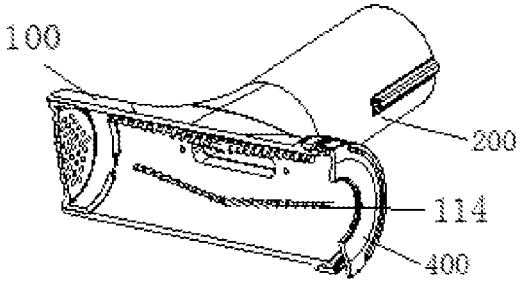
FIG. 15 is a sectional view showing the structure of cleaning strips according to Embodiment 8 of the present disclosure.

FIG. 15 is a sectional view showing the structure of cleaning strips according to Embodiment 8 of the present disclosure. As shown in FIG. 15, the difference between the present embodiment and Embodiment 5 is that the structure of the cleaning strip is changed. Specifically, in the present embodiment, the cleaning strip is a fourth cleaning strip 114 which is "V"-shaped. One or more third cleaning strips 114 may be available, and in the present embodiment, the number of the second cleaning strips 114 may be two.

In the present embodiment, after the filter is mounted in the filter cleaning apparatus, the covering body 400 is rotated so that the filter is driven by the buckling portion 421 on the covering body 400 to rotate, thus cleaning the dirt on the filter by the cleaning strips.

One of the cover structure (the fixing portion is rotatably connected on the connecting portion by the articulated shaft) in the present disclosure is set as an example, thus specifically describing the usage scenario of the present disclosure:

a user manually sleeves the covering body on the side end of the shielding body to finish its assembly when uses the filter cleaning apparatus of the present disclosure for the first time. When the filter needs to be placed in the shielding body, the fixing portion is opened by rotating around the articulated shaft, and then the filter is placed in the shielding body and the fixing portion is closed. At the moment, the fixing portion is rotated to a certain angle, so that the buckling portion on the fixing portion is abutted against the concave-convex structure of the filter; the fixing portion is continuously rotated, thus driving the filter to rotate for cleaning, namely the user may achieve the clamping between the fixing portion and the filter as well as the filter cleaning only by rotating the fixing portion without accurate alignment by naked eyes.

The user opens the fixing portion to take out the filter after cleaning the filter. In addition, the filter cleaning apparatus is kept in an assembled state, namely, it is unnecessary to assemble the apparatus again without disassembling the covering body when other filters need to be cleaned for the next time, and the user only needs to open the fixing portion and place the filter, then the cleaning is achieved.

To sum up, in the present disclosure, the covering body of the filter cleaning apparatus is rotatably sleeved on the side end of the shielding body, and the filter can be driven by the buckling portion on the covering body to rotate, thus achieving its cleaning by the cleaning strip in the shielding body. In the present disclosure, the user need not rotate the filter, but rotate the covering body which is easier to hold, thus cleaning the filter, which makes the operation more comfortable and convenient; in addition, the covering body is sleeved on the side end of the shielding body, thus improving the stability of rotation while cleaning the filter, and optimizing the user experience.

It is finally to be noted that the above embodiments are adopted not to limit but only to describe the technical solutions of the present disclosure. Although the present disclosure has been described with reference to the above-mentioned embodiments in detail, those of ordinary skill in the art should know that modifications may still be made to the technical solutions recorded in each embodiment or equivalent replacements may be made to part of technical features therein. These modifications or replacements do not make the essences of the corresponding technical solutions depart from the spirit and scope of the technical solutions of each embodiment of the present disclosure.

What is claimed is:

1. A filter cleaning apparatus, used in combination with a dust collection apparatus, comprising a filter and a shielding body for containing the filter to be cleaned, wherein at least one cleaning strip for scraping the filter to be cleaned is arranged on an inner surface of a wall of the shielding body, a dust collection connector is arranged on the shielding body, one end of the dust collection connector is communicated with a cavity in the shielding body, and the other end of the dust collection connector is a hollow structure for connecting and communicating with the dust collection apparatus; and wherein the filter cleaning apparatus is a separate accessory for cleaning the filter to be cleaned after being taken off from the dust collection apparatus, when the dust collection apparatus is connected with the dust collection connector and operates, dirties scrapped by the at least one cleaning strip are sucked into the dust collection apparatus via the dust collection connector;

wherein the inner surface of the wall of the shielding body is provided with a clamping groove for fixing the cleaning strip, and the clamping groove is correspondingly arranged with a tail end of the cleaning strip.

2. The system according to claim 1, wherein a blocking portion is arranged on a side end of the shielding body, and one or more openings are arranged in the blocking portion.

3. The filter cleaning apparatus according to claim 1, wherein the cleaning strip is bar-shaped and is arranged parallel to a central axis of the shielding body.

4. The filter cleaning apparatus according to claim 1, wherein the cleaning strip is bar-shaped and is arranged obliquely to a central axis of the shielding body.

5. The filter cleaning apparatus according to claim 1, wherein the cleaning strip is arc-shaped and is arranged perpendicular to a central axis of the shielding body.

6. The system according to claim 1, wherein the cleaning strip is "V"-shaped.

7. The filter cleaning apparatus according to claim 1, further comprising a covering body, wherein the covering body comprises a connecting portion and a fixing portion, and the connecting portion is rotatably sleeved on a side end of the shielding body, and the fixing portion is connected on the shielding body by the connecting portion, and a buckling portion is arranged on a position, towards the shielding body, of the fixing portion.

8. The filter cleaning apparatus according to claim 7, wherein the fixing portion is rotatably connected on the connecting portion by an articulated shaft.

9. The filter cleaning apparatus according to claim 8, wherein an annular groove is arranged on an outer wall of the side end of the shielding body, a limiting block is arranged on the connecting portion, and the limiting block is correspondingly arranged to the annular groove.

10. The filter cleaning apparatus according to claim 7, wherein the shielding body is provided with a dust suction connector, one end of the dust suction connector is communicated with a dust suction apparatus, and the other end thereof is communicated with a cavity in the shielding body.

11. The filter cleaning apparatus according to claim 1, wherein the shielding body comprises a first shielding and a second shielding which are buckled with each other, and the first shielding and the second shielding are hinged together on one end, and the other end thereof is provided with a positioning portion for buckling.

12. The filter cleaning apparatus according to claim 11, wherein the positioning portion is a lug boss and an opening hole arranged correspondingly.

13. The filter cleaning apparatus according to claim 1, wherein the at least one cleaning strip for scraping the filter to be cleaned is arranged directly on the inner surface of the wall of the shielding body.

* * * * *